US009969060B2

(12) United States Patent
Fukui et al.

(10) Patent No.: US 9,969,060 B2
(45) Date of Patent: May 15, 2018

(54) CLAMP APPARATUS

(71) Applicant: SMC CORPORATION, Chiyoda-ku (JP)

(72) Inventors: Chiaki Fukui, Abiko (JP); Kazuyoshi Takahashi, Koto-ku (JP); Hideki Sasaki, Toride (JP); Masaharu Kobayashi, Tsukubamirai (JP)

(73) Assignee: SMC CORPORATION, Chiyoda-ku (JP)

( * ) Notice: Subject to any disclaimer, the term of this patent is extended or adjusted under 35 U.S.C. 154(b) by 0 days. days.

(21) Appl. No.: 15/119,088

(22) PCT Filed: Feb. 12, 2015

(86) PCT No.: PCT/JP2015/054505
§ 371 (c)(1),
(2) Date: Aug. 15, 2016

(87) PCT Pub. No.: WO2015/125841
PCT Pub. Date: Aug. 27, 2015

(65) Prior Publication Data

US 2016/0354902 A1 Dec. 8, 2016

(30) Foreign Application Priority Data

Feb. 24, 2014 (JP) ..... 2014-033170

(51) Int. Cl.
*B25B 1/08* (2006.01)
*B25B 5/16* (2006.01)
(Continued)

(52) U.S. Cl.
CPC ..... *B25B 5/16* (2013.01); *B25B 5/064* (2013.01); *B25B 5/087* (2013.01)

(58) Field of Classification Search
USPC ..... 269/221
See application file for complete search history.

(56) References Cited

U.S. PATENT DOCUMENTS 5,904,358 A * 5/1999 Hosono ..... B25B 5/087 269/126
2001/0003388 A1 6/2001 Takahashi et al.
(Continued)

FOREIGN PATENT DOCUMENTS

CN 103029078 A 4/2013
JP 2001-287127 A 10/2001
(Continued)

OTHER PUBLICATIONS

International Search Report and Written Opinion dated May 12, 2015 in PCT/JP15/054505 Filed Feb. 12, 2015.
(Continued)

*Primary Examiner* — Joseph J Hail
*Assistant Examiner* — Shantese McDonald
(74) *Attorney, Agent, or Firm* — Oblon, McClelland, Maier & Neustadt, L.L.P.

(57) ABSTRACT

A clamp apparatus includes a pair of first and second clamp arms supported rotatably on a body. The clamp apparatus also includes a manual release mechanism capable of manually releasing a clamped state in the case that an output from a drive unit to the first and second clamp arms is stopped and the clamped state of a workpiece is locked. The manual release mechanism includes a release lever disposed rotatably on a first plate body. By an operator operating the release lever to thereby rotate the release lever, a block body of a driving force transmission mechanism is pressed and moved upwardly, and pressing forces applied to the first and second clamp arms in widthwise outside directions thereof by a pair of rollers, are released. Consequently, gripping members of the first and second clamp arms are rotated in directions away from each other to thereby cause an unclamped state.

4 Claims, 7 Drawing Sheets

(51) Int. Cl.
*B25B 5/06* (2006.01)
*B25B 5/08* (2006.01)

(56) References Cited

U.S. PATENT DOCUMENTS

| | | | | |
|---|---|---|---|---|
| 2003/0151183 | A1* | 8/2003 | Yokota | B23Q 17/002 269/25 |
| 2011/0291341 | A1* | 12/2011 | Sawdon | B25B 5/062 269/216 |
| 2016/0136789 | A1 | 5/2016 | Fukui et al. | |

FOREIGN PATENT DOCUMENTS

| | | | |
|---|---|---|---|
| JP | 2009-279698 | A | 12/2009 |
| JP | 4950123 | B2 | 6/2012 |
| WO | WO 2014/025055 | A1 | 2/2014 |
| WO | 2015/008807 | A1 | 1/2015 |

OTHER PUBLICATIONS

Combined Chinese Office Action and Search Report dated May 3, 2017 in Patent Application No. 201580009650.5 (with English language translation).
Combined Chinese Office Action and Search Report dated Dec. 19, 2017 in Patent Application No. 201580009650.5 (with English language translation).

* cited by examiner

CLAMP APPARATUS

TECHNICAL FIELD

The present invention relates to a clamp apparatus for clamping workpieces on an automated assembly line or the like.

BACKGROUND ART

Heretofore, for example, in an automated assembly line for automobiles, an assembly process has been performed in which clamping is carried out by a clamp apparatus under a condition in which pre-formed frames are positioned in an overlaid manner and the frames are welded together.

In one such clamp apparatus, as disclosed in Japanese Patent No. 4950123, a pair of two clamp arms are provided respectively on left and right sides, the clamp arms being disposed for rotation respectively through pins. Further, proximal ends of the clamp arms are supported pivotally via a base which is connected to a drive unit, whereby distal ends of the clamp arms are operated to open and close. Thus, a workpiece such as a frame or the like is gripped from the left and right by the distal ends of the pair of clamp arms.

SUMMARY OF INVENTION

On an assembly line on which the above-described clamp apparatus is installed, for example, if for some reason the assembly line is subjected to an emergency stop, supply of electrical energy and/or pressure fluid with respect to a drive unit of the clamp apparatus is suspended, and due to the driving force by the drive unit being extinguished, the clamped state of a workpiece by the clamp arms becomes locked.

In such a condition, for example, for investigating the cause of a trouble, it may be necessary for the workpiece to be taken out or removed. However, since the workpiece is kept in the clamped state by the clamp arms, in some cases, it is not possible for the workpiece to be taken out from the clamp apparatus.

A general object of the present invention is to provide a clamp apparatus, which is capable of easily and reliably releasing a clamped state manually, in the case that an output from a drive unit has been stopped.

The present invention is characterized by a clamp apparatus for, by rotation of a pair of clamp arms, clamping a workpiece between one of the clamp arms and another of the clamp arms, the clamp apparatus including:

a body;

a drive unit disposed on the body and including a displacement member that is displaced along an axial direction;

the pair of clamp arms, which are supported rotatably with respect to the body, and are arranged in confronting relation to each other;

a driving force transmission mechanism including pressing members configured to press ends of the clamp arms, and which is connected to the drive unit, and the driving force transmission mechanism being configured to transmit to the clamp arms a driving force along an axial direction of the drive unit, to thereby cause rotation of the clamp arms;

cam members including pressing surfaces which are inclined at a predetermined angle with respect to the axial direction, the cam members being disposed on ends of the clamp arms, the cam members being pressed by the pressing members of the driving force transmission mechanism abutting against the pressing surfaces; and manual release means configured to release a clamped state of the workpiece by the clamp arms.

According to the present invention, in the clamp apparatus, which includes the cam members on ends of the pair of clamp arms, the cam members are pressed by the pressing members of the driving force transmission mechanism under a driving action of the drive unit, so that the ends of the pair of clamp arms are rotated, whereby the workpiece is clamped. In addition, even in the case that, for some reason, the drive unit is stopped and the driving force therefrom is extinguished, since the clamped state can easily and reliably be released by the manual release means, the workpiece can assuredly be taken out and removed from the clamp apparatus.

DESCRIPTION OF EMBODIMENTS

Figure 1:
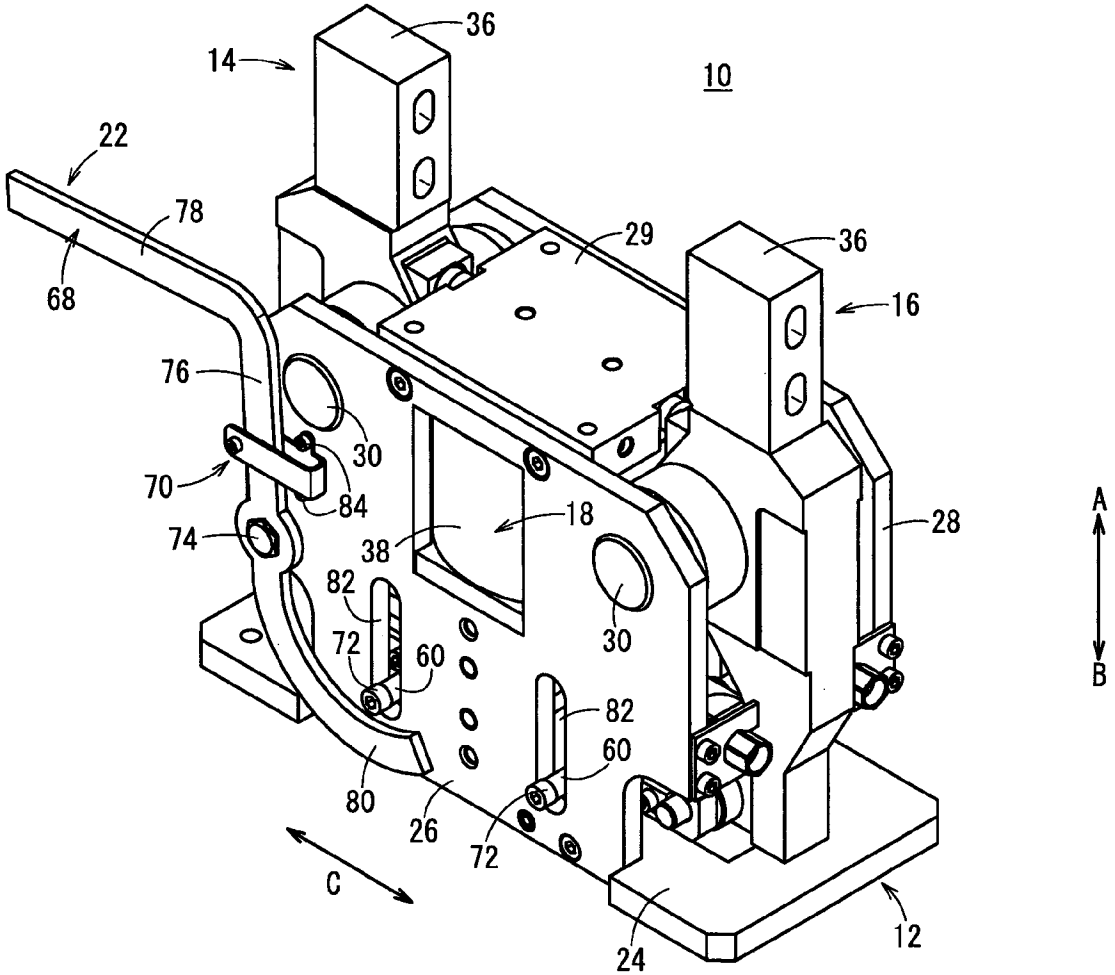
FIG. 1 is an external perspective view of a clamp apparatus according to an embodiment of the present invention.

As shown in FIGS. 1 through 7, a clamp apparatus 10 includes a body 12, a pair of first and second clamp arms 14, 16 pivotally supported rotatably on the body 12, a drive unit 18 fixed to the body 12, a driving force transmission mechanism 20 that transmits driving forces of the drive unit 18 to the first and second clamp arms 14, 16, and a manual release mechanism 22, which is capable of forcibly releasing, by manual operation, the clamped state of a workpiece W that is clamped by the first and second clamp arms 14, 16.

The body 12, for example, is made up from a base 24, which is formed in a planar shape and is arranged in a horizontal direction, and a pair of first and second plate bodies 26, 28, which are connected respectively to both side surfaces of the base 24, and which are separated mutually by a predetermined distance. The first and second plate bodies 26, 28 are perpendicular to the base 24, and are formed at predetermined heights in an upward direction (the direction of the arrow A). The manual release mechanism 22 is mounted on the first plate body 26.

The base 24, for example, is placed on a floor surface or the like, and is then fixed to the floor surface through non-illustrated bolts or the like, whereby the clamp apparatus 10 is fixed in a given location.

Further, at an upper portion of the body 12, a ceiling portion 29 is connected between end portions of the first plate body 26 and the second plate body 28. The ceiling portion 29 is arranged perpendicularly with respect to a direction of extension (the direction of arrows A and B) of the first and second plate bodies 26, 28, and is disposed on the body 12 substantially centrally in the widthwise direction (the direction of the arrow C) thereof. In addition, a workpiece W, which is clamped by the first and second clamp arms 14, 16, is placed on the ceiling portion 29.

The first and second clamp arms 14, 16, for example, are formed with substantially symmetrical shapes, are disposed on the body 12 between the first plate body 26 and the second plate body 28, and are supported rotatably on the body 12, respectively, through arm pins 30 that are inserted through substantially central portions along the longitudinal direction of the clamp arms 14, 16.

Figure 4:
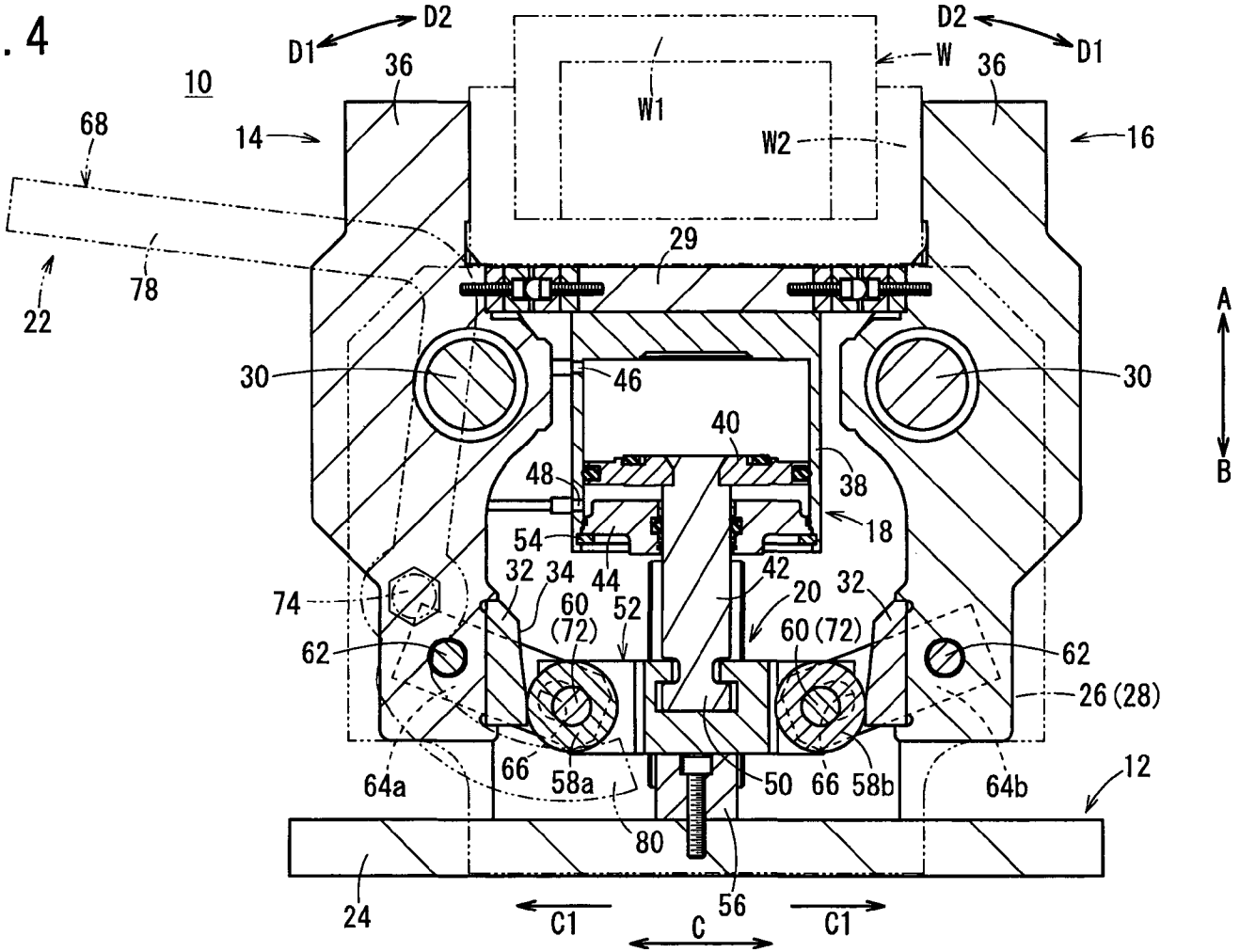
FIG. 4 is a front view with partial omission showing a condition in which a first plate body is taken out from the clamp apparatus of FIG. 3.
Figure 5:
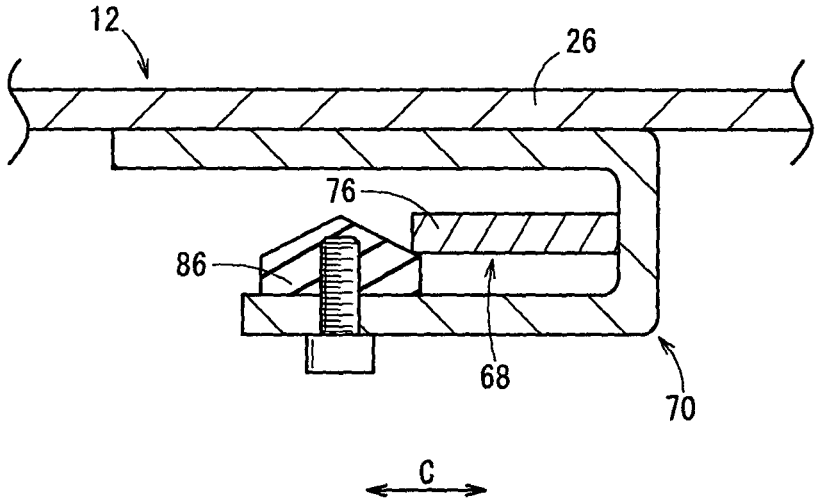
FIG. 5 is a cross sectional view taken along line V-V of FIG. 3.
Figure 7:
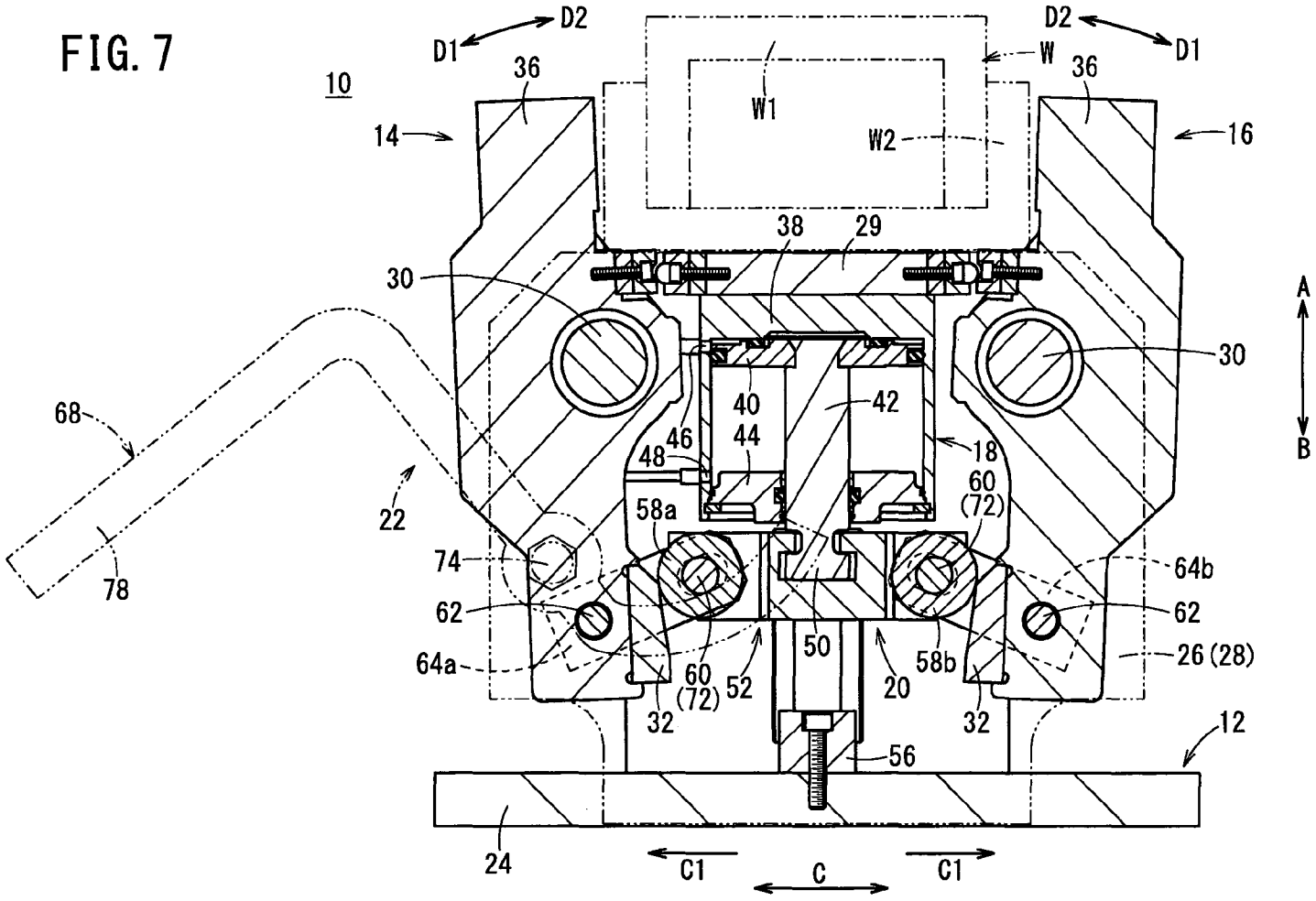
FIG. 7 is a front view with partial omission showing a condition in which a first plate body is taken out from the clamp apparatus of FIG. 6.

As shown in FIGS. 4 and 7, cam members 32 are disposed on mutually confronting side surfaces on ends of the first and second clamp arms 14, 16 that are arranged on the side of the base 24 (in the direction of the arrow B).

The cam members 32 are formed in block-like shapes, for example, and are installed in recesses formed on side surfaces on the ends of the first and second clamp arms 14, 16. Together therewith, the cam members 32 include cam surfaces (pressing surfaces) 34 on inward sides in the widthwise direction of the clamp apparatus 10. The cam surfaces 34 are inclined at predetermined angles, such that the cam members become gradually narrowed in width toward the other end side (in the direction of the arrow A) of the first and second clamp arms 14, 16.

In addition, the cam members 32 are disposed detachably with respect to the ends of the first and second clamp arms 14, 16 through non-illustrated fastening bolts, in a condition that the cam surfaces 34 are arranged to face toward the center of the clamp apparatus 10.

On the other hand, on other ends of the first and second clamp arms 14, 16, gripping members 36 are formed for clamping the workpiece W. The gripping members 36 have mutually confronting gripping surfaces, which are substantially rectangular in cross section, and are formed with vertical surfaces that lie substantially in parallel with the longitudinal directions of the first and second clamp arms 14, 16.

Further, the arm pins 30 are formed into a shaft-like shape. At a position between the one end and the other end of each of the first and second clamp arms 14, 16, the arm pin 30 is inserted perpendicular to the longitudinal direction of each of the first and second clamp arms 14, 16. In addition, both ends of the arm pins 30 are supported respectively on the first and second plate bodies 26, 28. Consequently, the first and second clamp arms 14, 16 are rotatably supported on the body 12 through the arm pins 30, which are inserted through substantially central portions of the first and second clamp arms 14, 16.

The drive unit 18 is arranged between the first plate body 26 and the second plate body 28, and is disposed at a position in the center of the first and second plate bodies 26, 28 and the base 24.

The drive unit 18, for example, is an air cylinder that is driven under the supply of a pressure fluid. The drive unit 18 includes a bottomed tubular cylinder tube 38, a piston (displacement member) 40 disposed displaceably in the interior of the cylinder tube 38, a piston rod 42 connected to the piston 40, and a rod cover 44 disposed in an opening of the cylinder tube 38 and which displaceably supports the piston rod 42.

On a side surface of the cylinder tube 38, first and second ports 46, 48 are formed that penetrate perpendicularly to the axial direction (the direction of arrows A and B) of the cylinder tube 38, to thereby provide communication between the interior and the exterior of the cylinder tube 38 through the first and second ports 46, 48. The first port 46 is disposed on one end side (in the direction of the arrow A), which is a bottom side of the cylinder tube 38, and the second port 48 is disposed on the other end side of the cylinder tube 38, which is the side of the rod cover 44 (in the direction of the arrow B).

Tubes, which are connected respectively through joints to a non-illustrated pressure fluid supply source, are connected to the first and second ports 46, 48, whereby the pressure fluid can be supplied selectively to either the first port 46 or the second port 48 under a switching action of a non-illustrated switching device. In addition, the cylinder tube 38 is fixed by non-illustrated bolts with respect to the ceiling portion 29.

The piston 40 is formed in, for example, a disk-like shape, with an end of the piston rod 42 being connected to the center thereof as a result of being inserted through and caulked integrally with the piston 40. Further, the other end of the piston rod 42 projects to the exterior of the cylinder tube 38 through the rod cover 44. A connector 50, which is initially reduced in diameter and then expands outward in diameter again, is formed on the other end of the piston rod 42. A block body 52, which constitutes part of the driving force transmission mechanism 20, is connected to the connector 50.

The rod cover 44, after being inserted into the interior of the cylinder tube 38, is latched in place by a locking ring 54 that is engaged with the inner circumferential surface of the cylinder tube 38, and the piston rod 42 is displaceably inserted through the center of the rod cover 44.

A block-shaped stopper 56 is fixed to the base 24 at a position below the piston rod 42 (in the direction of the arrow B), such that when the piston 40 and the piston rod 42 are lowered under a driving action of the drive unit 18, further displacement of the block body 52 (to be discussed below), which is connected to the piston rod 42, is restricted by the block body 52 abutting against the stopper 56.

The driving force transmission mechanism 20 includes the block body 52, which is connected to the other end of the piston rod 42, a pair of rollers (pressing members) 58*a*, 58*b*, which are pivotally supported, respectively, in the vicinity of opposite ends of the block body 52, and a pair of link arms 64*a*, 64*b*, which are supported between roller pins 60 that pivotally support the rollers 58*a*, 58*b* and link pins 62 of the first and second clamp arms 14, 16.

The block body 52 extends in a direction (the direction of the arrow C) perpendicular to the axial direction (the direction of arrows A and B) of the piston rod 42, and in a center portion thereof, a groove is formed into which the connector 50 of the piston rod 42 is inserted. Additionally, by insertion of the connector 50 into the groove of the block body 52, the block body 52 is connected and displaced integrally in a state of being arranged perpendicularly with respect to the axial direction of the piston rod 42.

Further, the block body 52 has a predetermined length along the widthwise direction (the direction of the arrow C), with opposite ends thereof being formed at equal distances about the axial line of the piston rod 42. On the opposite ends of the block body 52, a pair of rollers 58*a*, 58*b* are supported rotatably via the roller pins 60, which are disposed perpendicularly to the direction of extension of the block body 52. The rollers 58*a*, 58*b* are arranged between ends, which are formed in a bifurcated manner, of the block body 52, and are disposed to project respectively from the ends toward the first and second clamp arms 14, 16.

In addition, opposite side surfaces of the rollers 58*a*, 58*b* are covered by the ends of the block body 52. Additionally, one of the rollers 58*a*, which is disposed on the side of the first clamp arm 14, and the other of the rollers 58*b*, which is disposed on the side of the second clamp arm 16, face respectively toward the cam surfaces 34 of the cam members 32, and the outer circumferential surfaces of the rollers 58*a*, 58*b* abut against the cam surfaces 34.

Furthermore, the link arms 64*a*, 64*b* have predetermined lengths in the axial direction. Link slots 66, which open with oval shapes elongated in a longitudinal direction, are formed in end portions of the link arms 64*a*, 64*b*, with the roller pins 60 being inserted respectively through the link slots 66.

On the other hand, in the other ends of the link arms 64*a*, 64*b*, the link pins 62, which are pivotally supported on the ends of the first and second clamp arms 14, 16, are inserted through holes (not shown). Consequently, the ends of the link arms 64*a*, 64*b* are disposed swingably through the link pins 62, which are inserted through the non-illustrated holes, and additionally the link arms 64*a*, 64*b* are capable of moving predetermined distances in the longitudinal direction of the block body 52 through the roller pins 60, which are inserted through the link slots 66.

In addition, by lowering the block body 52 under a driving action of the drive unit 18, the rollers 58*a*, 58*b* are rotated in a state of abutment against the cam surfaces 34 of the cam members 32, and via the cam surfaces 34, the ends of the first and second clamp arms 14, 16 are pressed by predetermined pressing forces in directions (the directions of the arrows C1) to separate mutually away from each other. On the other hand, by the block body 52 being raised, the ends of the first and second clamp arms 14, 16 are pulled by the link arms 64*a*, 64*b* in directions to mutually approach each other.

Figure 2:
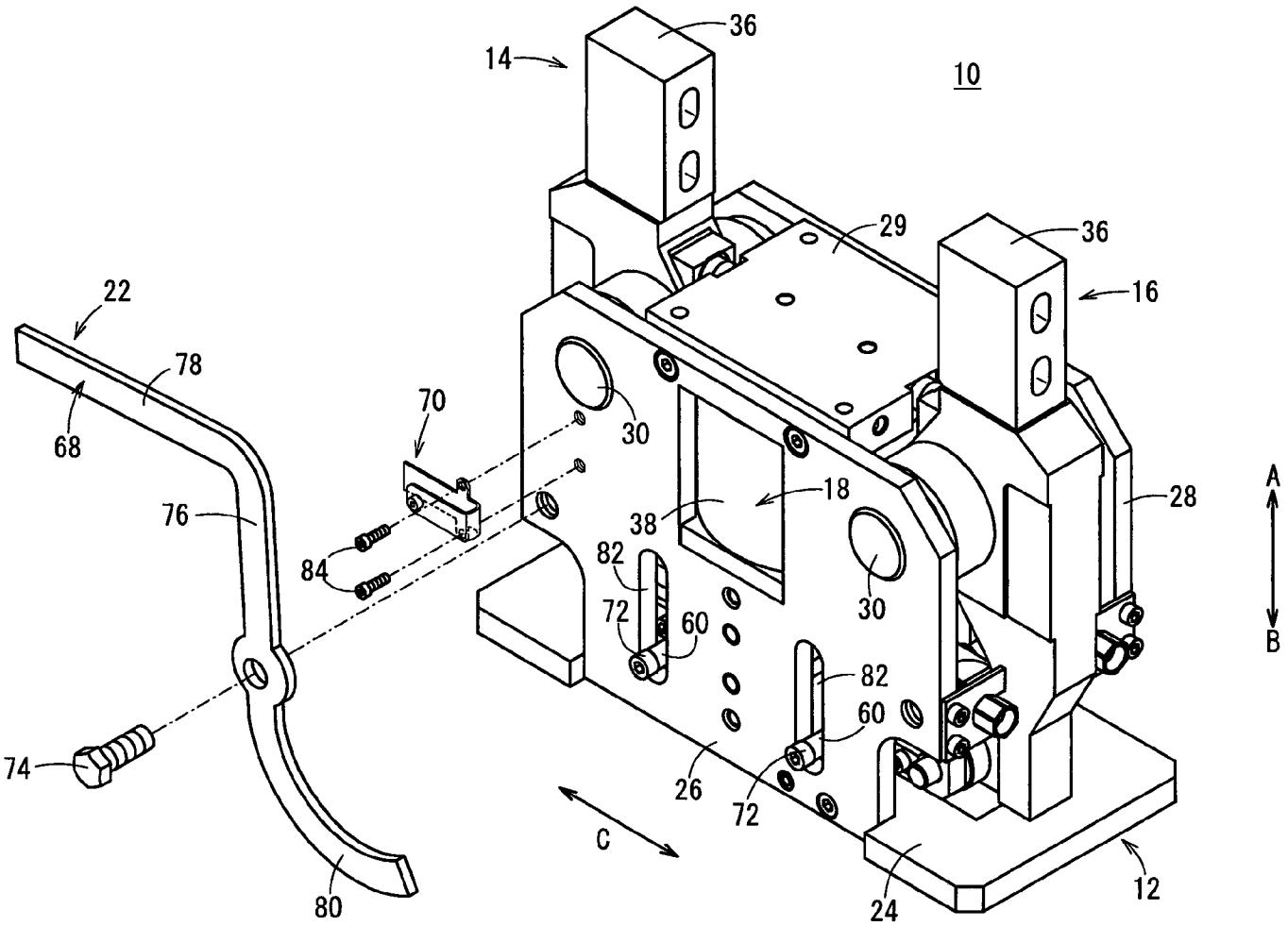
FIG. 2 is an exploded perspective view of a manual release mechanism provided in the clamp apparatus of FIG. 1.
Figure 3:
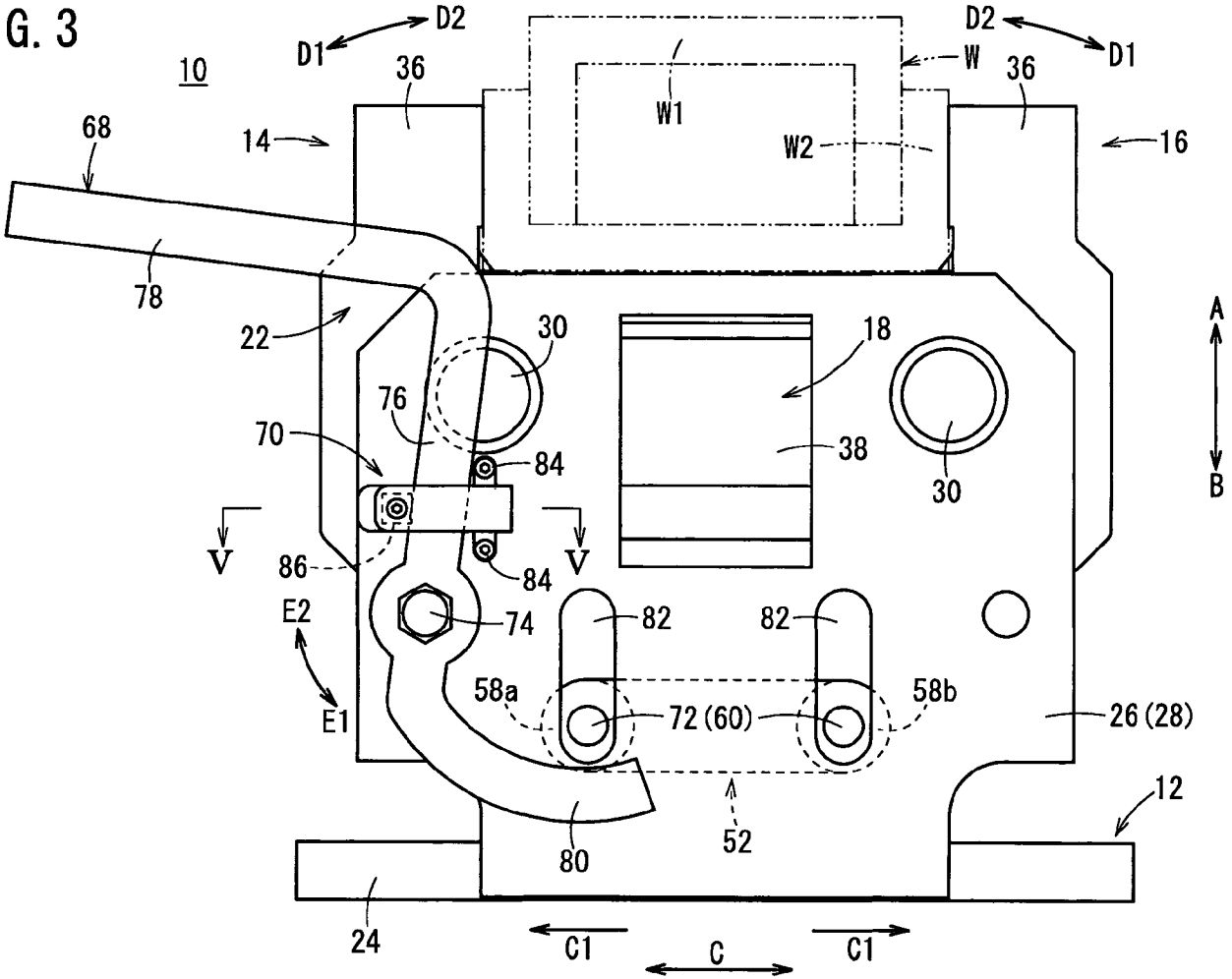
FIG. 3 is a front view showing a clamped state of the clamp apparatus of FIG. 1.

As shown in FIGS. 1 through 3, the manual release mechanism 22 includes a release lever (urging member) 68, which is disposed rotatably on the first plate body 26 of the body 12, a holder 70 that retains the release lever 68, and connecting pins (projecting members) 72 connected to the roller pins 60 that make up the driving force transmission mechanism 20, and which are pressed by the release lever 68.

The connecting pins 72 are not limited to a structure connected separately with respect to the roller pins 60, and may, for example, be formed integrally with the roller pins 60.

The release lever 68, for example, is constituted from a plate having a predetermined thickness, and is disposed rotatably with respect to a side surface of the first plate body 26. In addition, the release lever 68 comprises a support part 76, which is supported on the first plate body 26 by a fixing bolt 74, an operating part 78 operated by an operator, and which is formed on an upper end of the support part 76, and an urging part 80, which extends with an arcuate shape in cross section from the lower end of the support part 76 and presses a portion of the driving force transmission mechanism 20. The operating part 78 extends substantially perpendicularly with respect to the support part 76, and the urging part 80 is formed to extend in an opposite direction from the operating part 78 with respect to the support part 76.

The operating part 78 is arranged to project in a widthwise outside direction from the first plate body 26, whereas the urging part 80 is formed with an arcuate downwardly oriented convex shape (in the direction of the arrow B).

The connecting pins 72 project from ends of the roller pins 60 that make up the driving force transmission mechanism 20, and are disposed coaxially therewith. By insertion of the connecting pins 72, respectively, through insertion slots 82 that open in the first plate body 26, the connecting pins 72 project by a predetermined length to the outside of the first plate body 26. The insertion slots 82 extend a predetermined length along the vertical direction (the direction of arrows A and B).

The holder 70 is formed with a substantially U-shape in cross section, for example, from an elastically deformable plate or the like. The holder 70 is fixed by bolts 84 to a side surface of the first plate body 26, and opens in a widthwise outside direction of the first plate body 26. Additionally, as shown in FIG. 3, the support part 76 of the release lever 68 is capable of being inserted into the interior of the holder 70, and is latched therein by a latching projection 86, which is disposed in the vicinity of the opening of the holder 70, to thereby restrict rotational movement of the release lever 68 (see FIG. 5).

Moreover, the manual release mechanism 22 is not limited to being disposed on the first plate body 26 side of the body 12, as described above. Alternatively, the manual release mechanism 22 may be disposed on the second plate body 28 side of the body 12.

The clamp apparatus 10 according to the present embodiment is constructed basically as described above. Next, operations and advantages of the clamp apparatus 10 will be described. In the following description, an unclamped state, in which the gripping members 36 of the first and second clamp arms 14, 16 are separated from each other, will be described as an initial position.

In the initial position, as shown in FIG. 7, a pressure fluid is supplied to the second port 48 in the drive unit 18, and a condition is assumed in which, by the piston 40 being raised, the first and second clamp arms 14, 16 are rotated in such directions (the directions of the arrows D1) that the gripping members 36 separate away from each other about the arm pins 30, through the rollers 58*a*, 58*b* and the block body 52 of the driving force transmission mechanism 20.

A brief description will be given, with reference to FIGS. 3 and 4, concerning the workpiece W that is gripped by the aforementioned clamp apparatus 10. The workpiece W is made up, for example, from a first frame W1, which is U-shaped in cross section and constitutes part of a frame of a vehicle, and a second frame W2, which is U-shaped in cross section and is intended for assembly onto the first frame W1.

In a state in which an opening of the first frame W1 is oriented downwardly (in the direction of the arrow B), the first frame W1 is placed between the gripping members 36 of the first and second clamp arms 14, 16. On the other hand, the second frame W2 is formed such that side walls thereof are inclined so as to expand gradually outward toward the opening side thereof, and the opening is arranged to face upwardly (in the direction of the arrow A). Additionally, the first frame W1 is placed on the ceiling portion 29, in a state in which the first frame W1 is inserted into the interior of the second frame W2.

In the foregoing manner, in a state in which the workpiece W has been set at a predetermined position on the clamp apparatus 10, initially, under a switching action of the non-illustrated switching device, the pressure fluid, which had been supplied to the second port 48 of the drive unit 18, is supplied instead to the first port 46. Accordingly, as shown in FIG. 4, by the pressure fluid that is introduced to the interior of the cylinder tube 38, the piston 40 is pressed toward the rod cover 44 (in the direction of the arrow B), and the piston rod 42 and the block body 52 are lowered integrally together with the piston 40.

Consequently, the pair of rollers 58*a*, 58*b* are lowered integrally with the block body 52, and the rollers 58*a*, 58*b* descend along the cam surfaces 34 of the cam members 32, against which the outer circumferential surfaces of the rollers 58*a*, 58*b* abut, whereby via the cam surfaces 34, which are recessed with arcuate shapes in cross section, the ends of the first and second clamp arms 14, 16 are pressed in directions (the directions of the arrows C1) to separate mutually away from each other.

As a result, the first and second clamp arms 14, 16 begin to rotate about the arm pins 30 in directions (the directions of the arrows D2) such that the gripping members 36 on the other ends approach each other, whereupon the pressing force applied to the cam members 32 from the rollers 58*a*, 58*b* becomes substantially constant, and therefore, the first and second clamp arms 14, 16 are rotated by a substantially constant rotational force.

By further lowering the block body 52 under a driving action of the drive unit 18, the rollers 58*a*, 58*b* press more against the cam surfaces 34 of the cam members 32, and via the cam members 32, the ends of the first and second clamp arms 14, 16 are pressed further in directions (the directions of the arrows C1) to separate mutually away from each other. Along therewith, the gripping members 36 of the first and second clamp arms 14, 16 are rotated further about the arm pins 30 in directions to approach each other, and move in directions to mutually approach the side walls of the second frame W2, and more specifically, the side walls of the second frame W2 are pressed and deformed toward the first frame W1 (in the directions of the arrows D2).

Furthermore, by lowering the block body 52, the pair of cam members 32 are pressed by the rollers 58*a*, 58*b* in directions (the directions of the arrows C1) to separate mutually away from each other, and accordingly the ends of the first and second clamp arms 14, 16 are pressed to move in directions (the directions of the arrows C1) away from each other. Consequently, the gripping members 36 of the first and second clamp arms 14, 16 are further rotated in directions (the directions of the arrows D2) to approach each other mutually, and the side walls of the second frame W2 are pressed and deformed to approach mutually toward each other, so that the side walls of the second frame W2 abut against the side walls of the first frame W1, and the side walls are substantially in parallel. At that time, a clamped state is brought about in which clamping is completed.

Lastly, in a state in which the first and second frames W1, W2 are clamped by the first and second clamp arms 14, 16, the side walls of the first and second frames W1, W2 are welded together, for example, using a non-illustrated welding device.

In this manner, by lowering the block body 52 of the driving force transmission mechanism 20 under a driving action of the drive unit 18, the cam surfaces 34 are pressed by the pair of rollers 58*a*, 58*b*, and via the cam members 32, the ends of the first and second clamp arms 14, 16 are pressed at a substantially constant force in directions (the directions of the arrows C1) to separate mutually away from each other. Consequently, since the first and second clamp arms 14, 16 can be rotated about the arm pins 30, until the rotating operation from the start of rotation of the first and second clamp arms 14, 16 is completed, the second frame W2 of the workpiece W is always pressed with a constant clamping force toward the first frame W1, and is then clamped.

On the other hand, in the event that the clamped state of the workpiece W by the first and second clamp arms 14, 16 is to be released, under a switching action of the non-illustrated switching device, the pressure fluid, which had been supplied to the first port 46 of the drive unit 18, is supplied instead to the second port 48. Consequently, upon being pressed by the pressure fluid, the piston 40 is raised, accompanied by the piston rod 42 and the block body 52 being raised integrally therewith.

Figure 6:
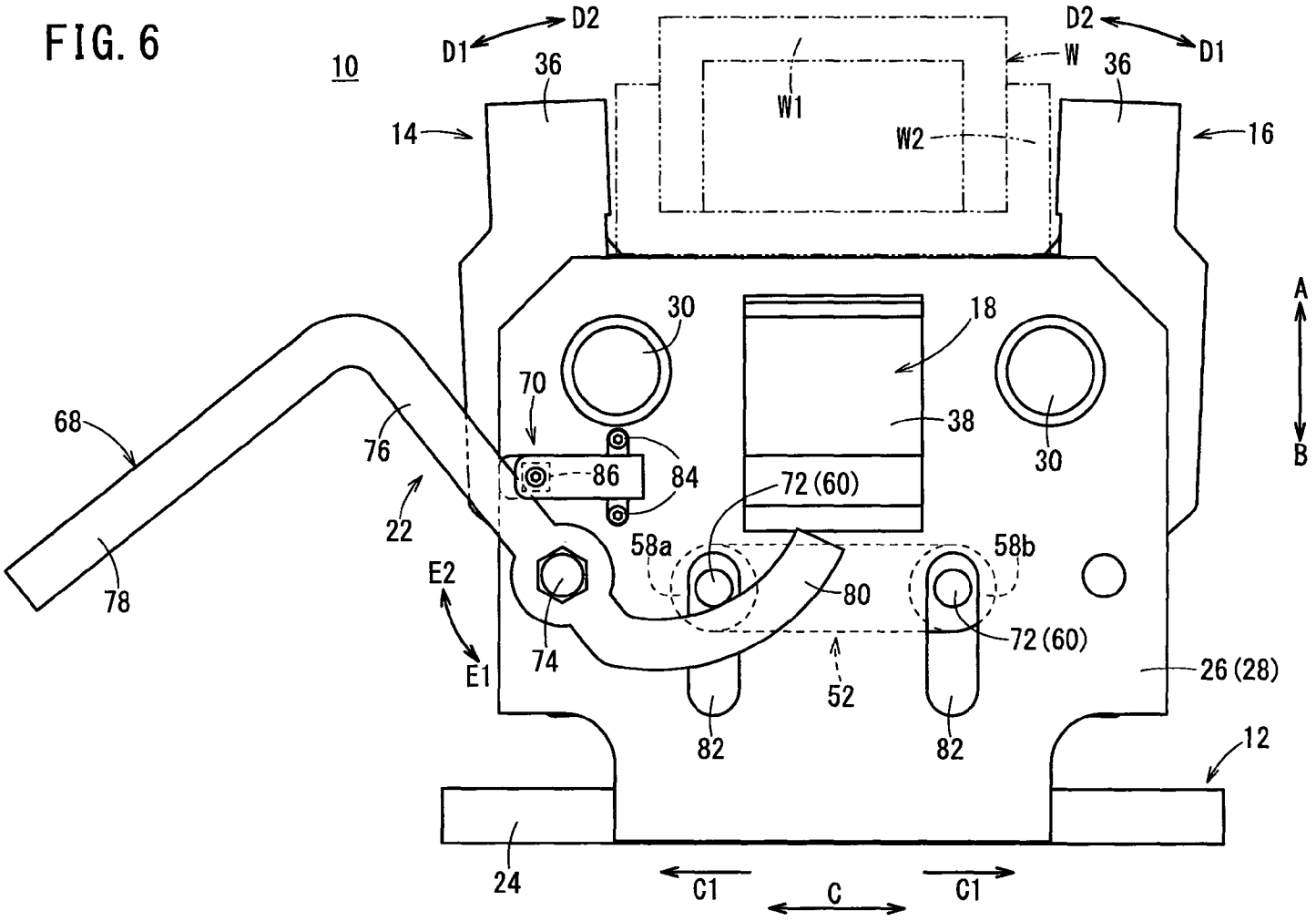
FIG. 6 is a front view showing an unclamped state of the clamp apparatus of FIG. 3.

In addition, the other ends of the link arms 64*a*, 64*b*, which are supported by the roller pins 60 to opposite ends of the block body 52, are raised, and accordingly the ends of the first and second clamp arms 14, 16 are pulled in directions to mutually approach each other due to the connection thereof with the link arms 64*a*, 64*b*. Consequently, the gripping members 36 of the first and second clamp arms 14, 16 are rotated in directions (the directions of the arrows D1) to separate away from each other mutually about locations where the first and second clamp arms 14, 16 are supported by the arm pins 30, and as shown in FIGS. 6 and 7, an unclamped state is brought about in which clamping of the workpiece W is released.

Next, a description shall be given concerning a case, in the aforementioned clamp apparatus 10, in which supply of pressure fluid to the drive unit 18 is stopped in a clamped condition of the workpiece W by the first and second clamp arms 14, 16. In the clamped condition shown in FIG. 4, since the piston 40 and the piston rod 42 of the drive unit 18 are lowered, accompanied by the block body 52 and the rollers 58*a*, 58*b* being lowered therewith, the connecting pins 72 are positioned in the vicinity of the lower ends of the insertion slots 82.

For example, during an emergency stoppage of the assembly line, in a condition in which supply of pressure fluid to the drive unit 18 is suspended, the clamped state of the workpiece W by the first and second clamp arms 14, 16 is locked and cannot be released.

In such a situation, first, in the condition shown in FIGS. 3 and 4, by a non-illustrated operator grasping and pressing the operating part 78 of the release lever 68 downwardly (in the direction of the arrow B), the release lever 68 is rotated counterclockwise (in the direction of the arrow E1) about the location where the support part 76 is supported. Along therewith, the support part 76 abuts against and elastically deforms the latching projection 86 of the holder 70, and by the elastic deformation, the support part 76 overcomes the latching projection 86 and is moved outside of the holder 70 from the opening thereof. Additionally, by the release lever 68 becoming completely separated outside of the holder 70, the rotational movement-restricted condition thereof is released.

Further, the operating part 78 is pressed downwardly (in the direction of the arrow B), whereby the urging part 80 is rotated upwardly (in the direction of the arrow A) about the support part 76, accompanied by the urging part 80 coming into abutment with the connecting pin 72, and thereafter pressing the connecting pin 72 upwardly, as shown in FIGS. 6 and 7. Consequently, the roller pins 60 that are connected to the connecting pins 72, the block body 52, the piston rod 42, and the piston 40 are pressed upwardly (in the direction of the arrow A) in unison.

As a result, the rollers 58*a*, 58*b* are raised along the cam surfaces 34 of the cam members 32, and the first and second clamp arms 14, 16 are rotated such that the gripping members 36 separate mutually away from each other, thereby resulting in an unclamped state. In this case, by the cam members 32, which are pressed by the rollers 58*a*, 58*b*, a large and boosted force is applied for biasing the first and second clamp arms 14, 16, which are in a clamped state. However, by the urging part 80, which is separated by a predetermined distance about the fixing bolt 74, applying a pressing force to the connecting pins 72, the pressing force that is applied from the rollers 58*a*, 58*b* with respect to the first and second clamp arms 14, 16 is overcome, and the first and second clamp arms 14, 16 can be forced to undergo an unclamping operation.

In this manner, by bringing about the unclamped state through operation of the manual release mechanism 22, even during an emergency stop of the assembly line, the clamped state of the workpiece W can easily and reliably be released to enable removal of the workpiece W.

In addition, after the clamped state has been released by the release lever 68 of the manual release mechanism 22, a non-illustrated operator grasps the operating part 78 and pushes the operating part 78 upwardly (in the direction of the arrow A). As a result, the release lever 68 is rotated clockwise (in the direction of the arrow E2) about the support part 76. Additionally, the support part 76 is inserted inside the holder 70 to latch the support part 76 over the latching projection 86, whereby the release lever 68 is restored again to the locked condition and cannot be rotated, whereupon the release operation is completed.

In the foregoing manner, with the present embodiment, the release lever 68 that makes up the manual release mechanism 22 is disposed rotatably, for example, on the outer side of the first plate body 26 that constitutes the body 12, and even in the case that supply of pressure fluid to the drive unit 18 is stopped and the workpiece W is locked in the clamped state, by operating the release lever 68, the connecting pins 72 connected to the roller pins 60 can be pressed upwardly. Therefore, the rollers 58*a*, 58*b*, which are in abutment against the cam members 32 and press the first and second clamp arms 14, 16 in widthwise outside directions, can easily and reliably be moved upwardly (in the direction of the arrow A) along the cam surfaces 34, so that the first and second clamp arms 14, 16 can be unclamped easily and reliably.

Further, with a simple structure made up of the release lever 68, the connecting pins 72, and the insertion slots 82, the manual release mechanism 22 can be constructed, which enables the clamped state to be released manually. Therefore, a manual release at the time of clamping can easily be performed, for example, by selective attachment of the manual release mechanism 22 with respect to the clamp apparatus 10. Furthermore, depending on the installation environment in which the clamp apparatus 10 is installed, the position where the release lever 68 is installed may suitably be selected from either one of both ends in the widthwise direction of the body 12, or the release levers may be disposed on both of such ends. In addition, the release lever 68 may be disposed on the second plate body 28 and not on the first plate body 26.

Moreover, in the case that the release lever 68 is not used, since the support part 76 thereof is accommodated and retained reliably in the interior of the holder 70, the release lever 68 cannot be rotated by mistake, so that unintended release of the clamped state is prevented.

The clamp apparatus according to the present invention is not limited to the above embodiment. Various changes and modifications may be made to the embodiment without departing from the scope of the invention as set forth in the appended claims.

The invention claimed is:

1. A clamp apparatus for, by rotation of a pair of clamp arms, clamping a workpiece between one of the clamp arms and another of the clamp arms, comprising:

a body;

a drive unit disposed on the body and including a displacement member that is displaced along an axial direction;

the pair of clamp arms, which are supported rotatably with respect to the body, and are arranged in confronting relation to each other;

a driving force transmission mechanism including pressing members configured to press ends of the clamp arms, and which is connected to the drive unit, the driving force transmission mechanism being configured to transmit to the clamp arms a driving force along an axial direction of the drive unit, to thereby cause rotation of the clamp arms;

cam members including pressing surfaces which are inclined at a predetermined angle with respect to the axial direction, the cam members being disposed on ends of the clamp arms, the cam members being pressed by the pressing members of the driving force transmission mechanism abutting against the pressing surfaces; and a manual release mechanism configured to release a clamped state of the workpiece by the clamp arms, wherein the manual release mechanism comprises an urging member configured to urge the pressing members along the axial direction, wherein the urging member is a lever that is disposed rotatably with respect to the body, wherein the pressing members are made to move by rotation of the lever.

2. The clamp apparatus of claim 1, wherein a holder configured to retain the lever is disposed on the body.

3. The clamp apparatus according to claim 2, wherein the holder includes an opening disposed along a direction of rotation of the lever, and by the lever passing through the opening and being accommodated in an interior of the holder, rotational movement of the lever is restricted.

4. The clamp apparatus according to claim 1, wherein projecting members that project outward of the body are disposed on the pressing members, and the projecting members are urged by abutment with the urging member.

* * * * *